US007887428B2

(12) United States Patent
Kurisu

(10) Patent No.: US 7,887,428 B2
(45) **Date of Patent: *Feb. 15, 2011**

(54) DEVICE FOR REDUCING EFFECT OF DOMINANT HAND ON GOLF SWING

(76) Inventor: Kazuo Kurisu, 76 Westbury St., Thousand Oaks, CA (US) 91360

( * ) Notice: Subject to any disclaimer, the term of this patent is extended or adjusted under 35 U.S.C. 154(b) by 17 days.

This patent is subject to a terminal disclaimer.

(21) Appl. No.: 12/378,136

(22) Filed: Feb. 12, 2009

(65) Prior Publication Data

US 2010/0184525 A1 Jul. 22, 2010

Related U.S. Application Data

(63) Continuation-in-part of application No. 12/218,970, filed on Jul. 21, 2008, now Pat. No. 7,591,733.

(51) Int. Cl.
*A63B 69/36* (2006.01)

(52) U.S. Cl. ..... 473/206; 473/204

(58) Field of Classification Search ..... 473/201, 473/203, 204, 206, 219, 226, 300, 302, 303
See application file for complete search history.

(56) References Cited

U.S. PATENT DOCUMENTS 3,256,023 A * 6/1966 Frazelle ..... 473/206
5,762,563 A * 6/1998 Holzhausen ..... 473/206
7,591,733 B1 * 9/2009 Kurisu ..... 473/206

* cited by examiner

*Primary Examiner*—Nini Legesse
(74) *Attorney, Agent, or Firm*—Irving Keschner

(57) ABSTRACT

A training device for use with a golf club. A cylindrical shaped member enables the device to be mounted on the grip of a golf club, the member having an inner cavity tapered to the matching angle of the grip surface and a cutout portion formed along a portion of the length of the device. A self-locking member is engaged with a post which is substantially perpendicular to the top surface of the mounting member, the height of the locking member being adjustable to accommodate the hand size of the golfer. A plurality of rib members formed at the bottom of the post allows the post diameter to be reduced while increasing post stabilization thus allowing the post to be smaller in diameter and longer in length.

9 Claims, 10 Drawing Sheets

10
12
14
16
30
32
80
82

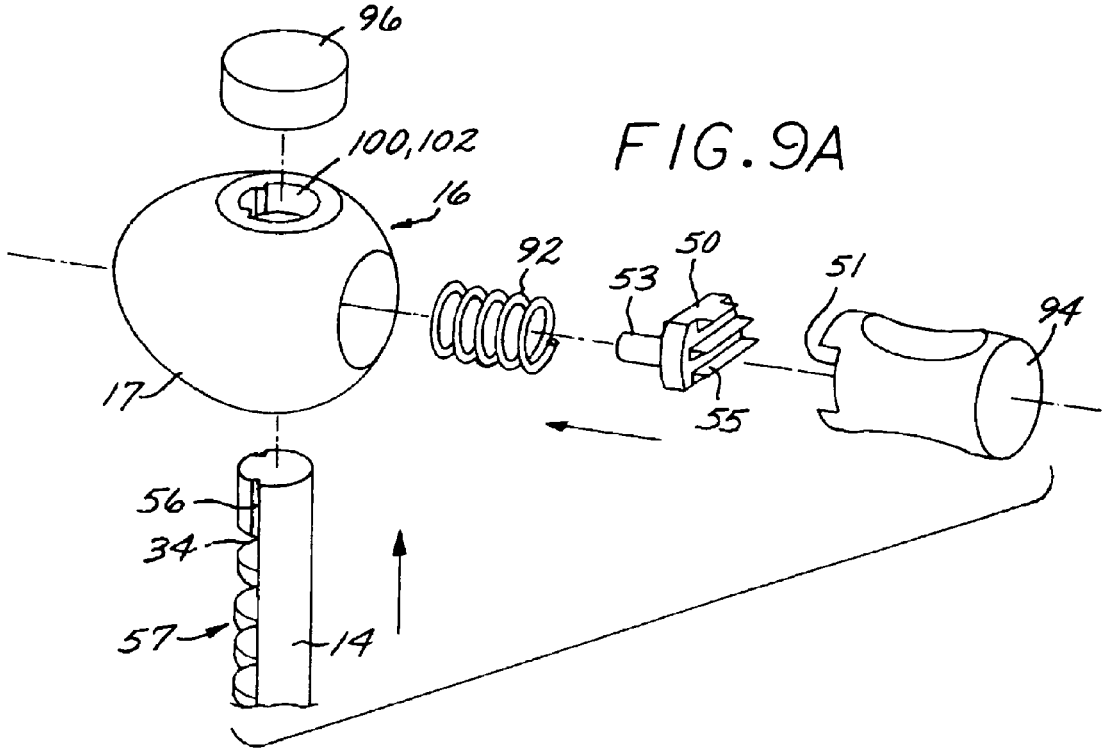
FIG. 9A
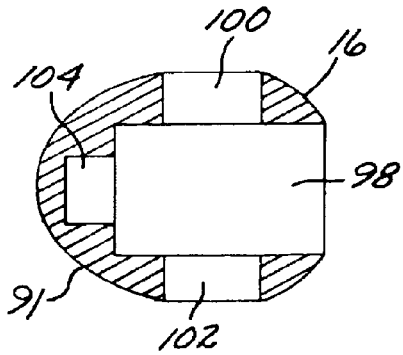
FIG. 9B
FIG. 9C
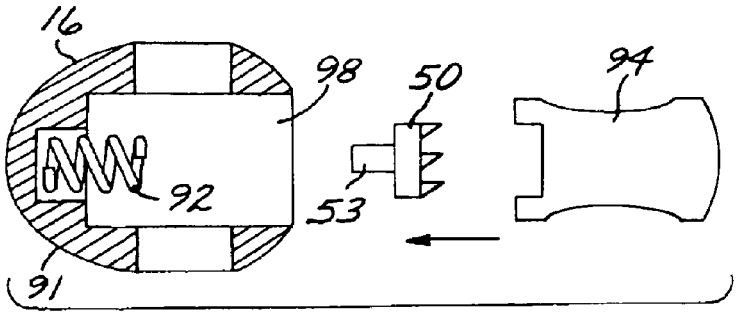

DEVICE FOR REDUCING EFFECT OF DOMINANT HAND ON GOLF SWING

RELATED APPLICATIONS

This application is a continuation-in-part of application Ser. No. 12/218,970 filed Jul. 21, 2008 now U.S. Pat. No. 7,591,733.

BACKGROUND OF THE INVENTION

1. Field of the Invention

The present invention provides a device attached to the shaft of a golf club that reduces the effect of the user's dominant hand on his/her golf swing and at the same time helps to define the correct swing path and impact timing.

2. Description of the Prior Art

It is well known that one of the most important elements and a key to a successful golf swing is the golfer's grip. The art of positioning the fingers, hands and pressure applied to the grip has been described numerous times. In addition, there have been many devices invented for the purpose of teaching and achieving an improved golf grip or swing.

The placement of hand and fingers on grip of club is rather easily accomplished by careful observation and following instructions. But the feeling of gripping a club and the amount and placement of pressure is very difficult to describe to an individual since each interprets and feels differently.

As simple as gripping a club is, it is the most recognized and believed to be the leading cause of an inconsistent golf swing. For an efficient swing, the importance of placement of fingers and hands is fundamental. But knowing the fundamental alone does not cure problems in inconsistency; most problems may be cured by understanding how the sub-dominant and dominant hand work together.

It is known that the sub-dominant hand leads and controls the path of the golf swing. However, many golfers tend to utilize the dominant side over the sub-dominant side, consciously or unconsciously, more than necessary. This can be caused by an increase of the grip pressure, usage of wrist, turning of the hand or even the body movement. Nervousness, anxiousness, desire, lack of concentration, . . . etc. can also cause this type of problem. The actual golf swing takes a very short time from start to finish and problems can occur anytime during the swing.

What is required to overcome these mistakes is to provide a device that is simple to use and allows the user to practice conveniently as possible and not to interfere in anyway with the practice swing and to be able to compare one's own swing to the correct swing and be able to repeat the corrected swing consistently for trust and self confidence.

One of the most common and leading cause of mistake in golf is the grip. In many cases, the positioning of the hand and its pressure applied to the grip will determine the swing path and the angle of the club head, especially at the point of impact with the golf ball. A golf swing uses every part of the body sequentially and/or simultaneously in continuous motion. Therefore, when the mistake occurs during the motion, it most likely creates another mistake that leads to others. The grip connects the user's body and the club and it is one of the most important elements of the resultant golf swing. The grip has to be securely connected and at the same time, be sensitive to the club feel.

The following illustrates how the grip and pressure effects the golf swing.

A. Positioning of Fingers and Hands:

Strong grip, which promotes the dominant hand to be active and most likely closes club face at impact.

Weak grip, which promotes an open club face at impact.

B. Place of and Amount of Pressure Applied:

Excess pressure, resulting in active hands.

Dominant hand takes authority of movement.

Arm and hand dominated swing, over the top, under cutting.

Premature turning of upper body.

Decrease swing speed.

Balance control.

Reverse Pivot.

Although the device described in co-pending application Ser. No. 12/218,970 filed Jul. 21, 2008, functions well, what is desired is to provide an improved golf training device which enables the tip of a golfer's index finger to touch the grip thereby reducing the friction surface of the cylindrically shaped member. It is also desired to provide a quick release system which does not utilize a screw action and provides a smooth surface for the golfer's hand while allowing a relatively easy and quick position adjustment.

SUMMARY OF THE INVENTION

The most common problems in having a successful golf swing is caused by an active dominant hand.

An effective golf swing requires that parts of the body be utilized differently than normally used for everyday life especially the dominant side of the body. The dominant hand has to be relaxed and the sub-dominant hand lead the swing.

The logic and theory are told and explained to the date but in reality even seasoned players occasionally make mistakes by letting the dominant hand be more active than necessary, a natural instinct of a typical golfer.

To overcome this instinct and the golf swing accordingly, the present invention provides a device attached to the golf club grip that is simple in design and simple to use. It is portable and can be used to compare the feeling of swing and correct an improper swing.

The device of the present invention provides the following advantages:

Able to go back and forth with device for quicker comparison and for better and faster learning.

Able to hit ball with device.

Better concentration for swing.

Better feel of impact zone, clearly and easy to understand body and hand position.

Better control of club head.

Better balance throughout the swing.

Better understanding of the timing of releasing the dominant side for power.

Better understanding of the role and task for the positions of the dominant hand.

Better understanding of where and what amount of pressure to apply on the grip.

Better chance to achieve, smooth and natural swing that fundamentally fits to an individual.

Exercise the proper use of power.

Exercise the feel of power transition, from leading (sub-dominant hand) to dominant hand.

Increase club head speed that leads to distance and spin to control the ball flight.

Learn role and task of sub-dominant hand.

Learn and understand the task of dominant hand.

Teaches proper movement (sequence of motion) fit to an individual's physical capabilities for the golf swing, leading to consistency and playing successful golf.

Understanding of position, angle of club head, and its affect.

The present invention will benefit all players, from beginners to advanced players.

A. For Beginners:

Ease of achieving smooth swing, which fit individual's physical capabilities.

Correct premature take-back and downswing by active dominant hand.

Learn how to use hands properly.

Utilizing sub-dominant and dominant hand the correct way.

Better feel of swing.

Better balancing, smooth, and consistent swing.

B. For Advanced Player:

Better understanding of relationship between club head and hand.

Ease of working on shot making.

Ease of correcting one's problem by themselves.

Improvement of direction, distance and timing, and for consistent and better golf.

Trusting own swing for confidence.

The training device of the present invention comprises a cylindrically shaped member that enables the device to be mounted to the grip of a golf club. The shaped member has an inner cavity tapered to press-fit into the grip surface and a cutout portion formed along a portion of the device length.

A self-locking member is engaged with a post which is substantially perpendicular to the top surface of the mounting member, the height of the locking member being adjustable to accommodate the hand size of the golfer. A plurality of ribs are formed on the inner cylindrical surface and extend a substantially portion of its length. A plurality of rib members formed at the bottom of the post allows the post diameter to be reduced while increasing post stabilization thus allowing the post to be smaller in diameter and longer in length.

DESCRIPTION OF THE DRAWINGS

For a better understanding of the present invention as well as other objects and further features thereof, reference is made to the following description which is to be read in conjunction with the accompanying drawing therein:

FIGS. 9A-9E illustrates the steps for assembling the self-lock hand holder;

DESCRIPTION OF THE INVENTION

For the sake of brevity, the golf training device embodiments shown in co-pending application Ser. No. 12/218,970 will not be set forth herein. However, the teachings necessary for an understanding of the present invention is incorporated herein by reference.

Figure 1A:
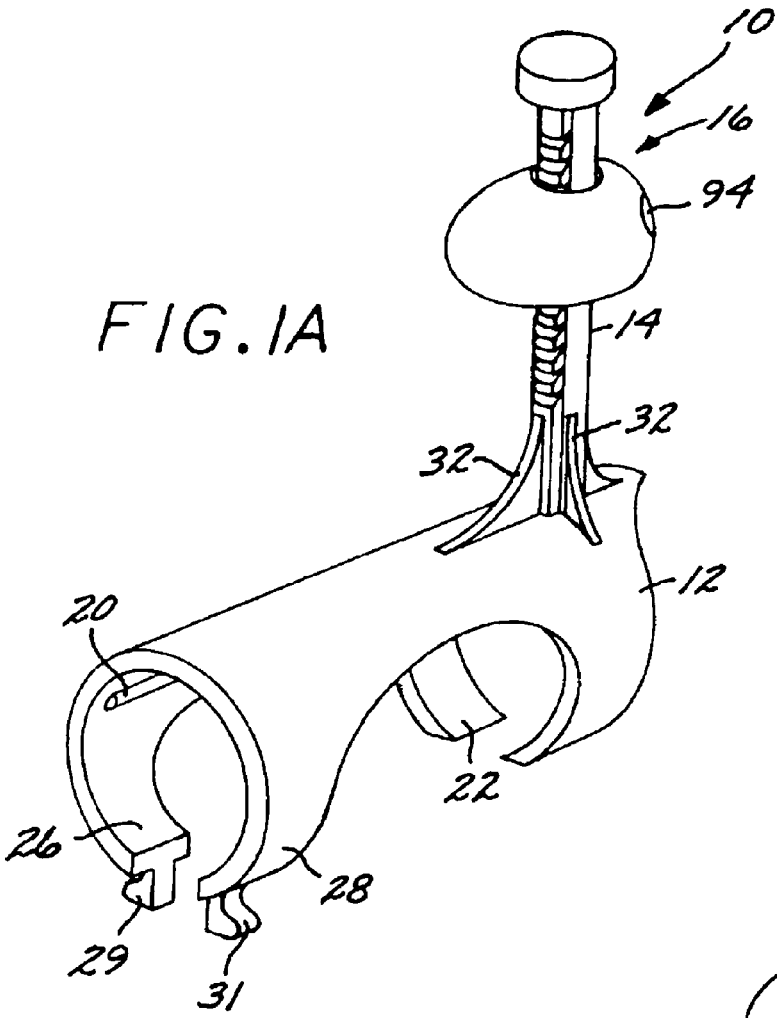
FIG. 1A illustrates a perspective view of a first embodiment of the device of the present invention and FIG. 1B shows the device of FIG. 1A with a safety latch.

FIG. 1A illustrates a first embodiment 10 of the device 10 of the present invention. It should be noted that components shown in figures having the same reference number are identical.

Device 10 comprises a cylindrically shaped member 12, post member 14 and hand holder, or support, 16.

Shaped member 12 has a portion, tapered inner cavity 18 that has a tapered angle that is slightly less than the outer tapered surface of a golf club grip, the smaller angle allowing device 10 to be press fit onto the grip.

Inner cavity 18 has a plurality of ribs 20 (only one shown) which prevents device 10 from twisting and turning when pushed in to contact the soft grip surface. Ribs 20 are essentially bumps, or protrusions, formed on the inside surface of member 12.

Figure 1B:
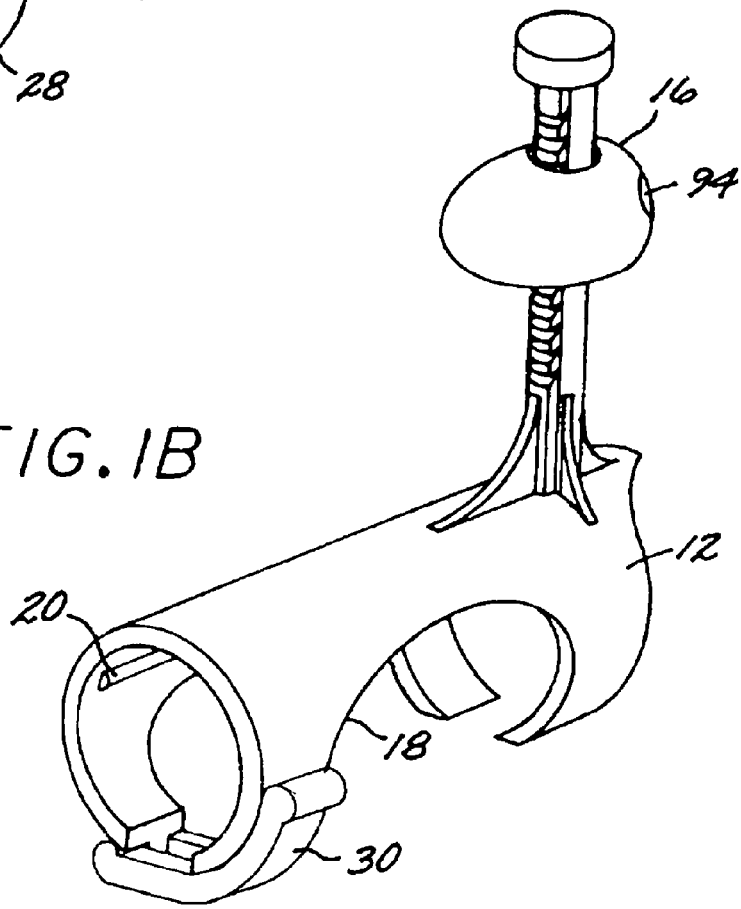

Cylindrical shaped member 12 has approximately a 0.400 inch separation between accurate lips, or end portions, 22, 24 and 26, 28 and an optional safety latch 30 (FIG. 1B) attached to provide an additional means to prevent device 10 from separating from the golf club while training. Lips 22, 24 and 26, 28 engage the club grip when pushed into position. Ribs 20 extend for substantially the entire length of cylindrical member 12. The bottom opening of cylindrical shaped member 12 has three purposes: (1) allowing device 10 to fit on the club; (2) allowing lips to be flexed open for positioning and to fit tightly when positioned on the club; and (3) accepting regulated grips.

Cylindrical shaped member 12 is formed in an ergonomic shape to minimize interference with the golfer's hand when the club is gripped normally. The tip of the user's index finger touches the club as in a normal grip (FIG. 10). Cutout portion 18 provides a reduced device friction surface, allowing ease of positioning the device 10.

Cylindrical shape member 12 may utilize safety latch 30 to prevent device 10 from accidentally coming apart from the golf club while training; safety notch 30 can be removed if necessary.

Post member 14 is attached to cylindrical shaped member 12 to form an integral unit and ribs 32 may be added for stability purposes.

The hand holder 16 (described in more detail with reference to FIGS. 9A-9E and 10A-10D) provides a smooth surface where the golfer's hand makes contact with the backside of post 14 and allows quick adjustment to accommodate a golfer's hand size; the notches 34 and teeth 50 forming a lock when the adjustment operation is completed.

Figure 2A:
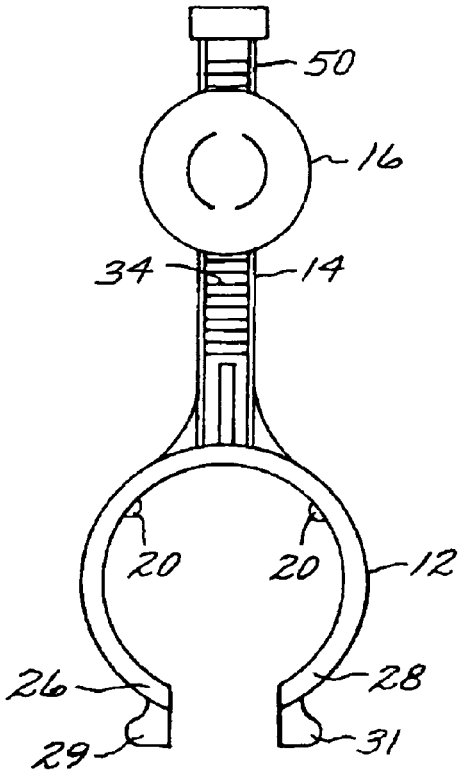
FIGS. 2A-2B show plan views of the embodiment shown in FIG. 1A.
Figure 2B:
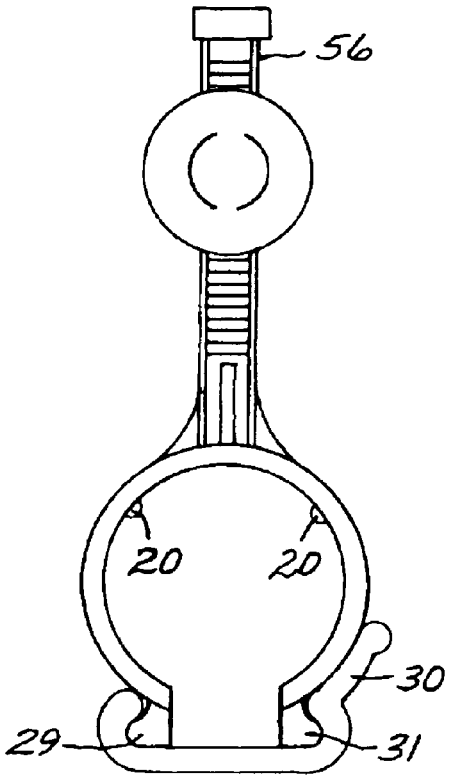

FIG. 2A shows two ribs 20, the ribs extending along the length of cylindrical member 12 and locking protrusions 29 and 31; FIG. 2B shows device 10 with safety latch 30 attached to cylindrical member 12 via protrusions 29 and 31.

Figure 3A:
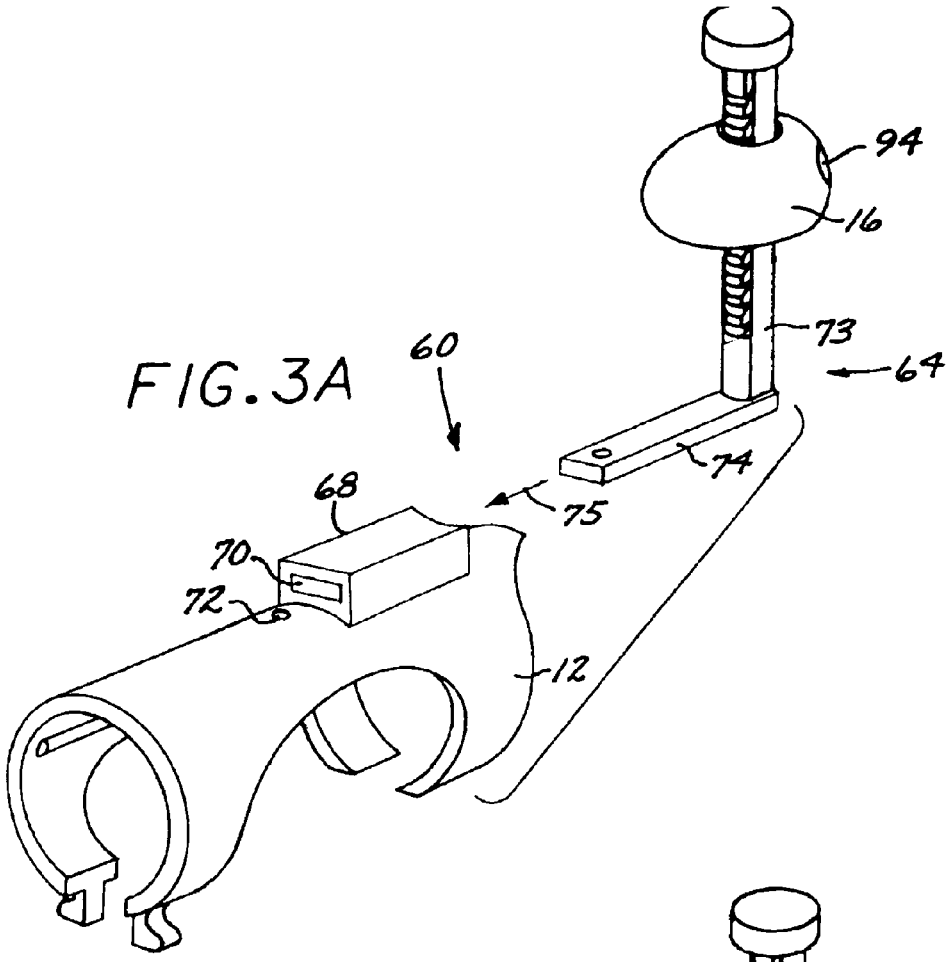
FIG. 3A illustrates a second embodiment of the device of the present invention.
Figure 3B:
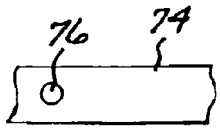
FIG. 3B is a view of the bottom surface of the hand support leg.
Figure 3C:
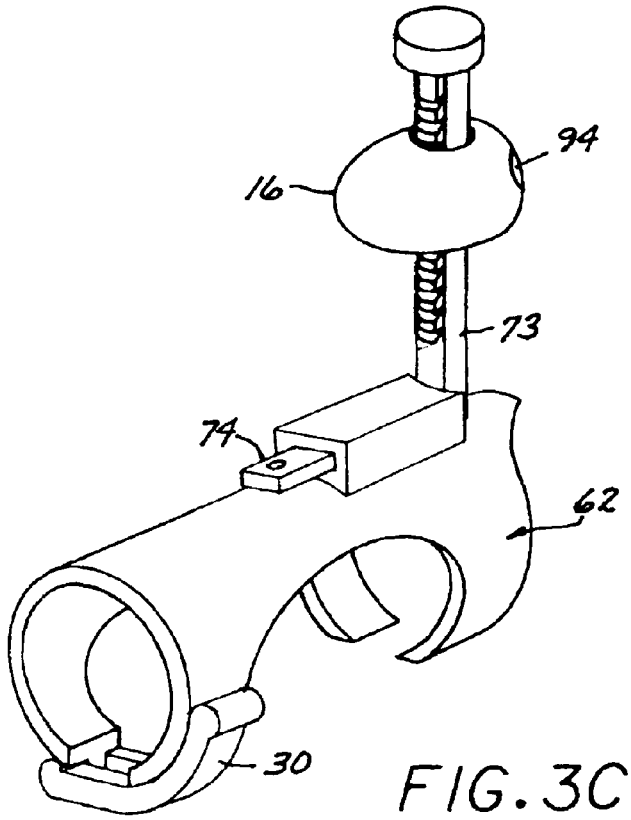
FIG. 3C shows the device of FIG. 3A with a safety latch.
Figure 4A:
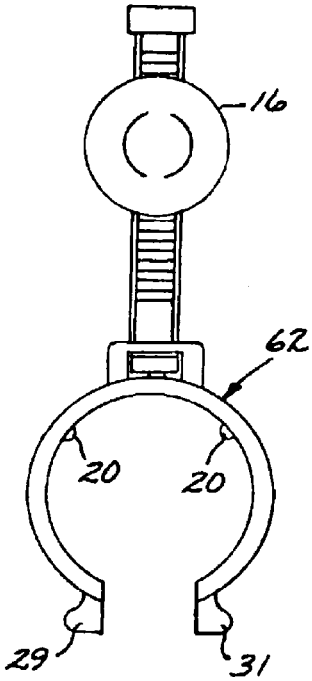
FIGS. 4A-4C show various views of the embodiment shown in FIG. 3A.
Figure 4C:
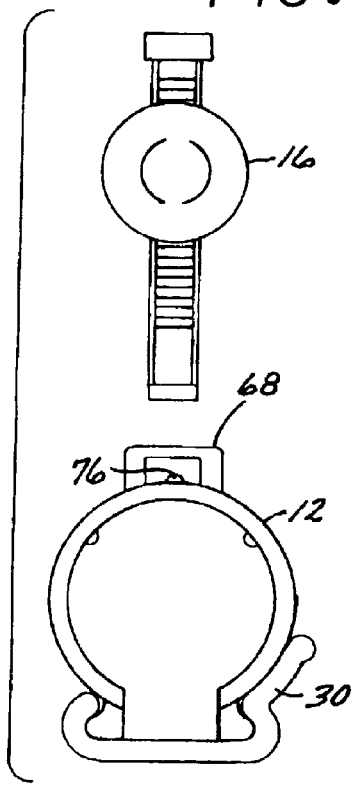
Figure 4B:
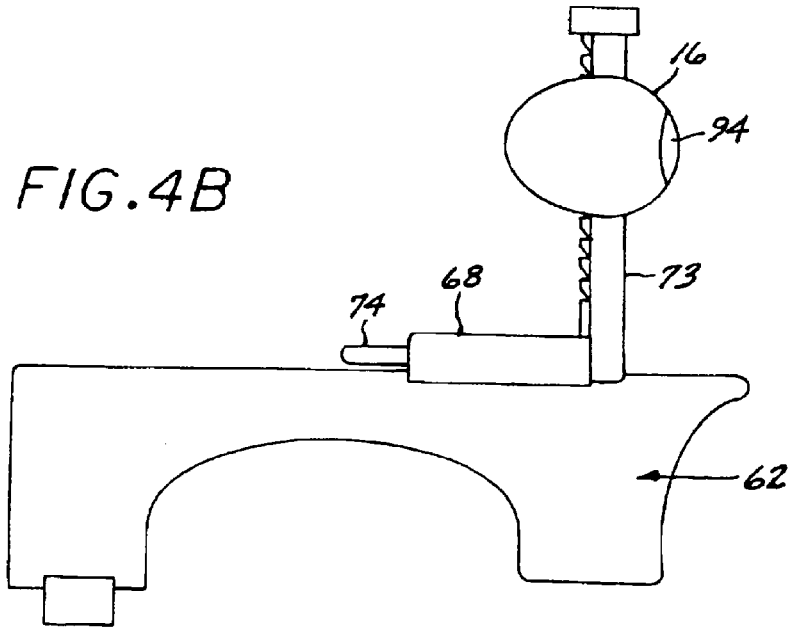

FIGS. 3A (without safety latch 30) and 3C (with safety latch 30) illustrate a second embodiment of the present invention. In particular, device 60 comprises an assembly of two components; cylindrically shaped member 62 and post member 64 with hand support 16 coupled thereto. Cylindrically shaped member 62 is similar to member 12 shown in FIG. 1A with the addition of a quick release post 64 in order to expedite the attachment/release of the post to/from cylindrically shaped member 62. Post 64 is L-shaped and comprises legs 73 and 74, leg 74 sliding into channel 70 formed in member 68. As shown in FIG. 3B, the bottom surface of leg 74 has an opening 76 formed therein. The top surface of member 62 has a vertically movable protrusion, or dimple, 72 formed thereon. The post 64 is secured to member 62 by a user inserting leg 74 into channel 70. (direction of arrow 75) in a manner such that protrusion 72 clicks into opening 76. A user can remove post 64 by pulling it in an opposite direction to arrow 75. In this case, protrusion 72 retracts, enabling the post 64 to be removed.

Figures 5, 6, 7:
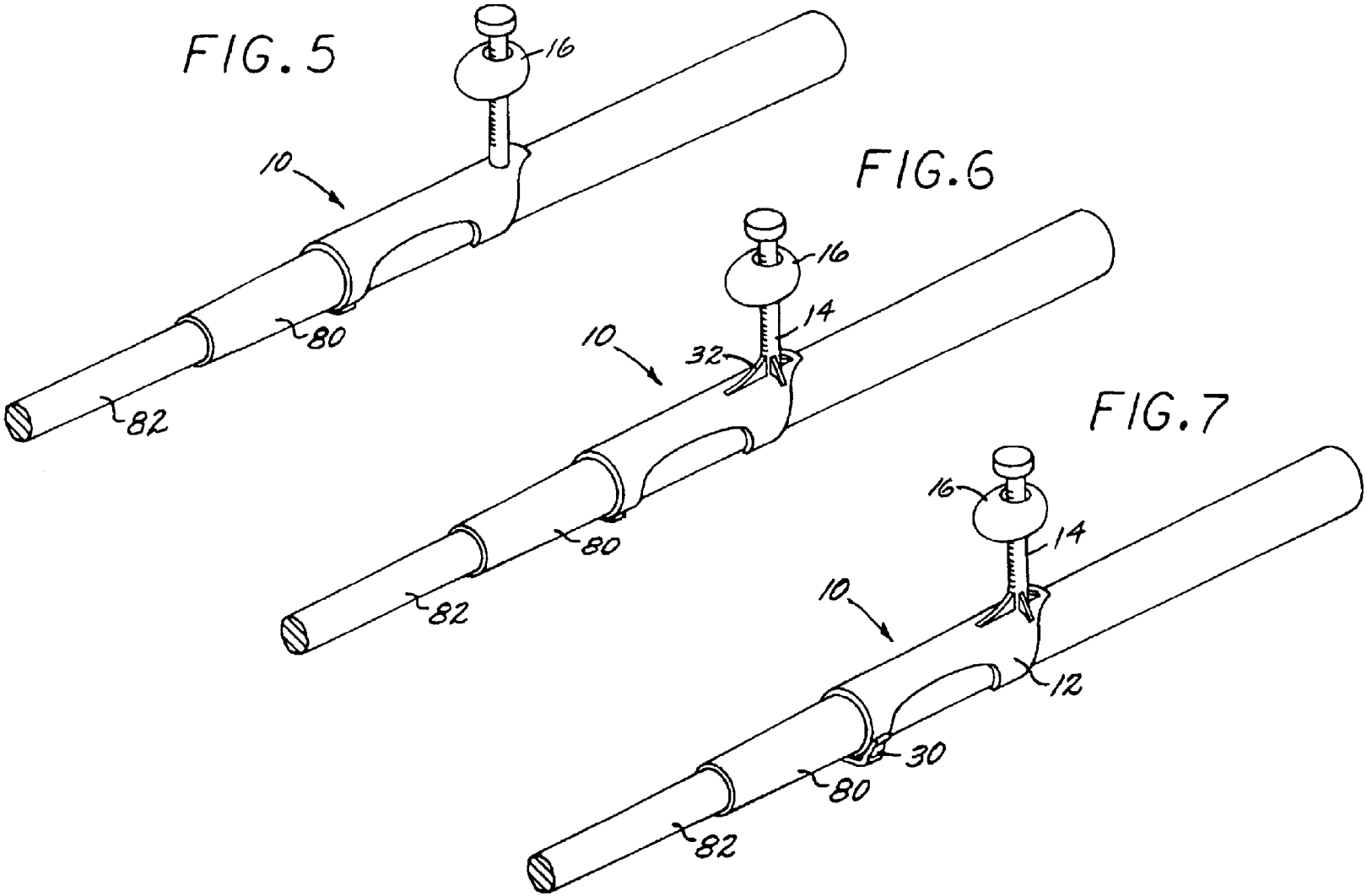
FIG. 5 illustrates the device of the present invention secured to a golf club grip, the device using a simple post.
FIG. 6 is similar to FIG. 5 except that the post has ribs associated therewith.
FIG. 7 shows the device of FIG. 6 with a safety latch attached thereto.

FIG. 5 shows device 10 mounted on grip 80 of golf club shaft 82, sleeve 10 not including stabilizing ribs; FIG. 6 is similar to FIG. 5 except that stabilizing rib 32 is provided at the bottom of post 14 and FIG. 7 illustrates device 10 with safety latch 30 attached to cylindrical member 12.

Figure 8A:
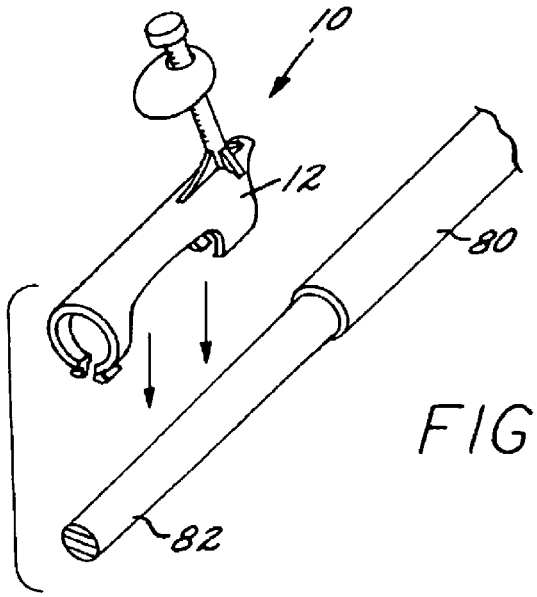
FIGS. 8A-8C illustrates the sequence for attaching the device of the present invention to a golf club grip.
Figure 8B:
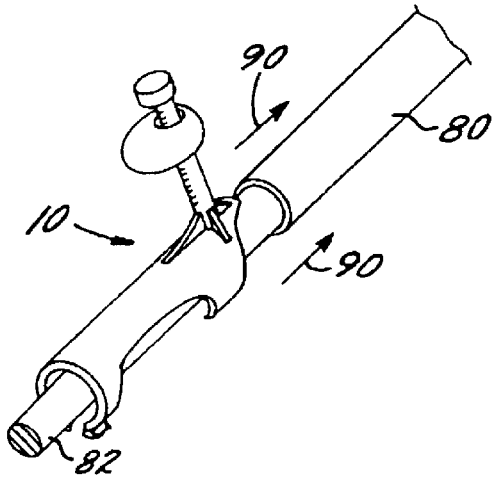
Figure 8C:
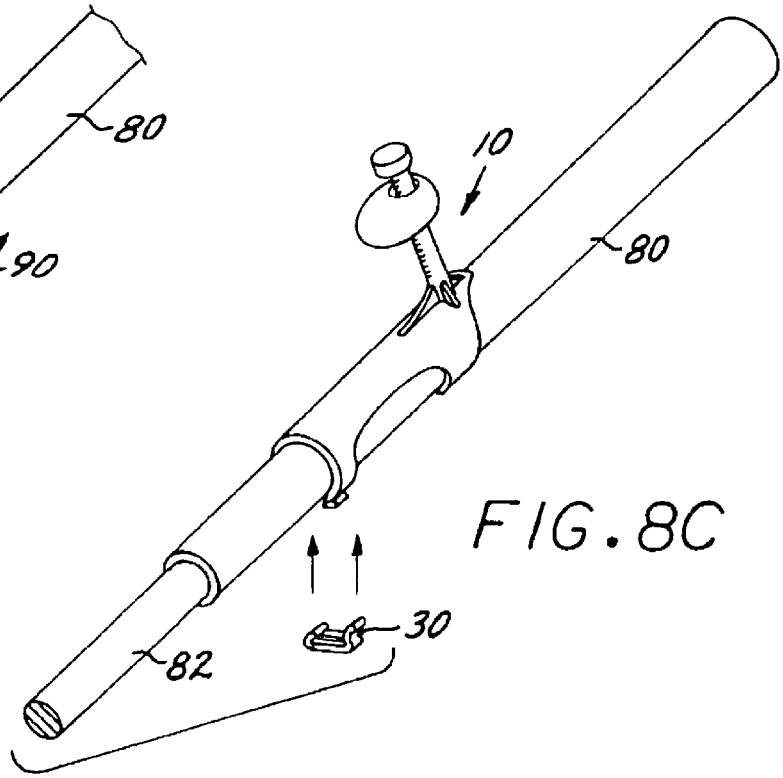

FIGS. 8A-8C illustrates the sequence for attaching device 10 to grip 80. In particular, device 10 is positioned over and mounted on shaft 82. Device 10 is then moved in the direction of arrows 90 (FIG. 8B) until it fits snugly on grip 80 (FIG. 8C). Safety latch 30 is then attached to member 12 in the manner described previously.

Figure 9D:
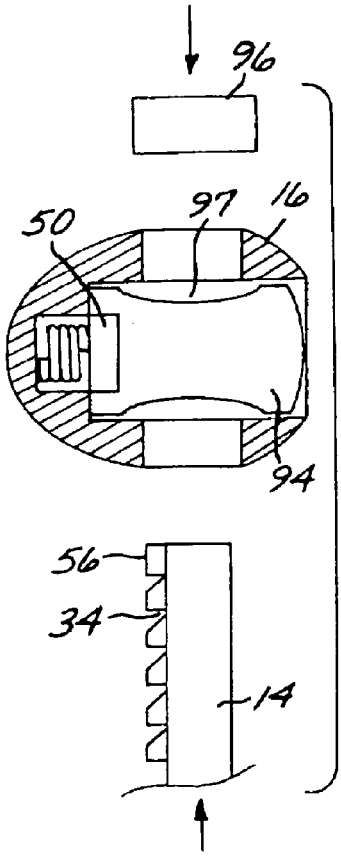

FIG. 9A illustrates the components forming hand holder 16 and comprises spring 92, tooth member 50 and button 94. FIG. 9B is a cross-section of holder 16, holder 16 comprising a shell 91 with an opening 98 and cavity 100, 102 for accepting post 14. FIG. 9C shows compression spring 92 inserted into opening 98 with tooth member 50 and button 94 positioned adjacent opening 98. FIG. 9D shows release button 94 pushed into opening 98 so that recess (opening) 97 is aligned with post 14, post 14 then sliding through the hand holder 16 as will be described in more detail hereinafter.

Figure 9E:
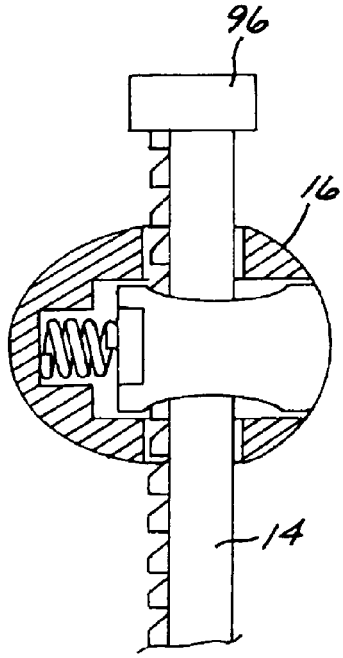

FIG. 9E shows cap 96 positioned on top of post member 14 with holder 16 mounted on post member 14 and holder 16 positioned in the locking mode.

Hand holder 16 comprised shell 17, spring 92, tooth member 50 and button 94.

Spring 92 fits into recess 104 through opening 98. Tooth member 50 fits into slot 51 in button 94, forming an integral unit when pushed into opening 98. Post 53 of tooth member 50 fits inside spring 92 as shown.

When a golfer pushes button 94 inward, spring 92 is compressed and holes 100 and 102 allows post member 14 to pass therethrough. When button 94 is released, teeth 55 on tooth member 50 and horizontal notches 34 on post member 14 engage and post member 14 is locked in position. Cap 96 is fitted on the top of post member 14 preventing holder 16 from being removed therefrom.

By pushing on button 94, teeth 55 disengage from notches 34 and holder 16 is free to move up or down; releasing button 94, locks holder 16 in position as described hereinabove.

Figure 10A:
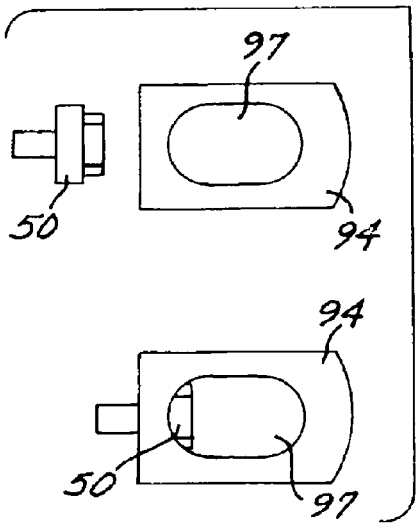
FIG. 10A is an enlarged top view of two components utilized with the hand holder of the present invention.
Figure 10B:
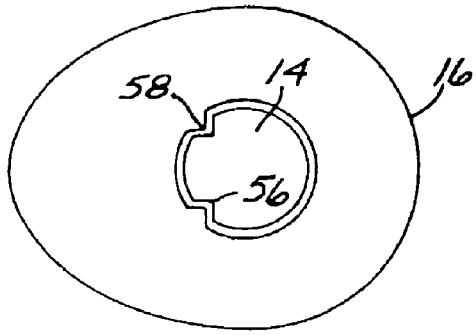
FIG. 10B is a top view of the hand holder positioned on post member 14, FIG. 10C are side views of the components shown in FIG. 10A
Figure 10C:
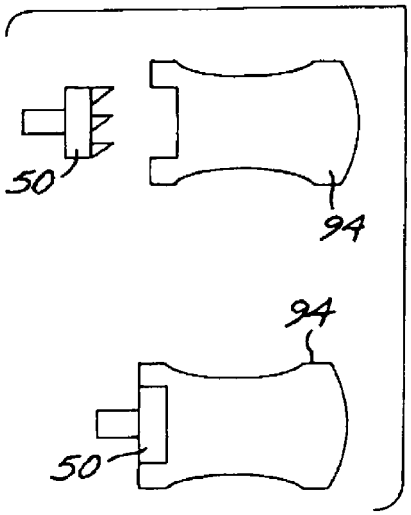
FIG. 10D is an enlarged cross-section of the hand holder mounted on post member 14.
Figure 10D:
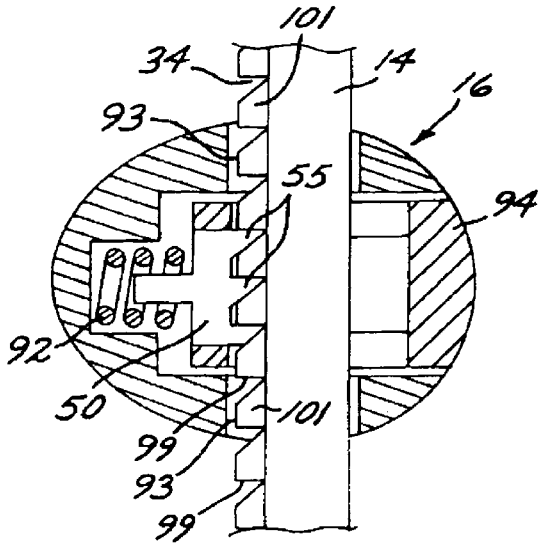

Member 50 has a set of triangular teeth 55 and surface 57 of post member 14 has triangular notches 34, flat on the top and side surfaces 93, 99. The shape of teeth 55 allows hand holder 16 to move easily in the upward or downward directions when button 94 is released and provides a secure lock when button 94 is pushed inward. When button 94 is released, the pressure of spring 92 forces teeth 55 on member 50 to fit into the notches 34 in a manner that prevents post member 14 from moving upwards. As illustrated in FIG. 10B, when holder 16 is on post member 14, vertical notches 56 of member 14 seats in corresponding notches 58 of holder 16 to prevent holder 16 from turning or twisting.

Figure 11:
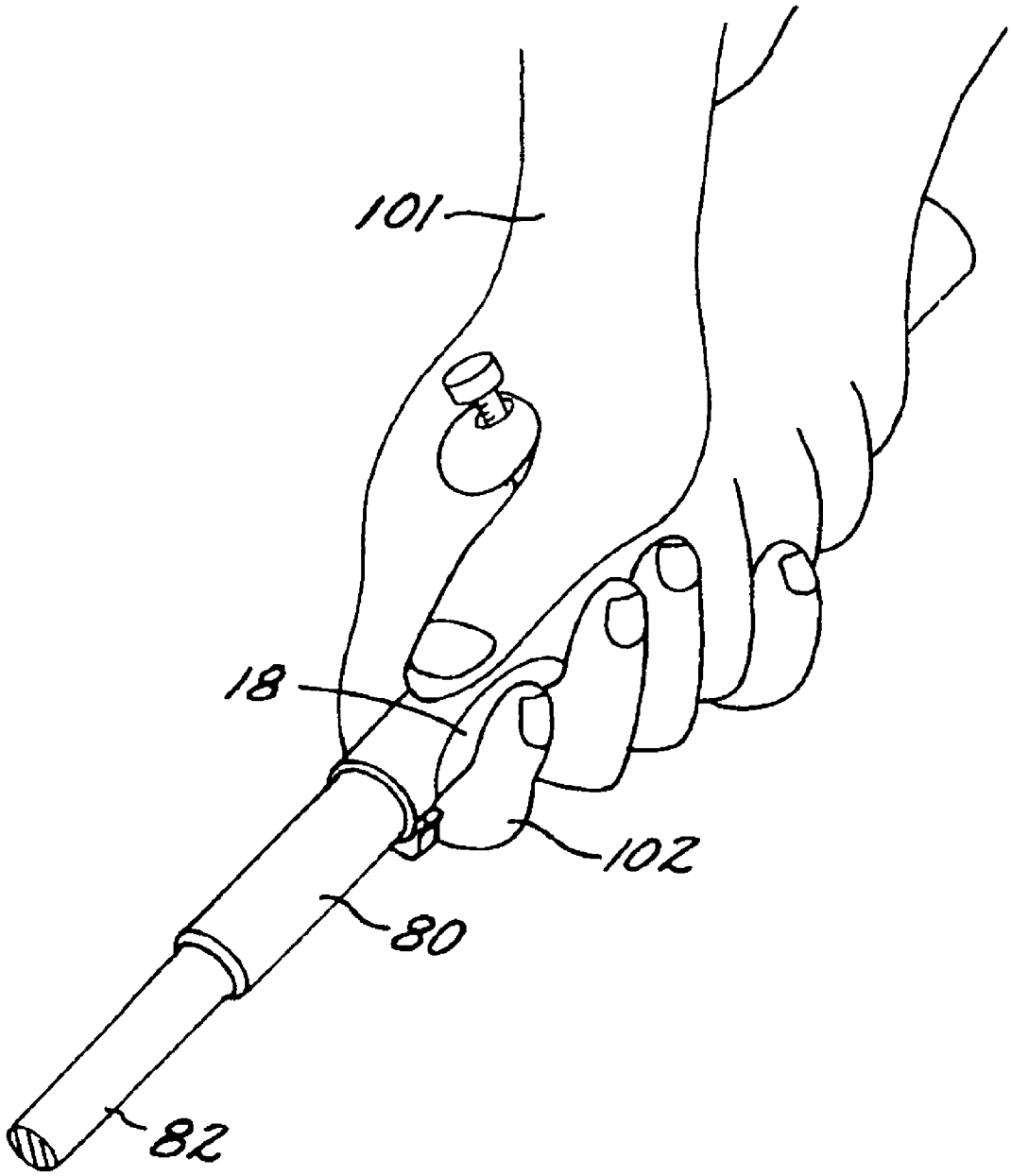
FIG. 11 illustrates the device positioned on a golf grip in a manner such that the index finger of a user engages the cutout portion of the device.

FIG. 11 illustrates a golfer's hand engaging device 10 with the index finger 102 engaging grip 80 through cutout portion 18.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teachings of the invention without departing from its essential teachings.

What is claimed is:

1. A device for reducing the effect of a golfer's dominant hand on his/her golf swing comprising:

a cylindrically shaped member having an interior cavity which extends along the length of said shaped member and an exterior surface, a cutout portion extending along a portion of said surface of said cylindrically shaped member, said shaped member being mounted on a golf club;

a vertically extending post member;

a postionable locking member coupled to said post member, said positionable member including means for enabling a golfer to securely position the locking member at a selected position on said post member and further including means for enabling a golfer to release the locking member and adjusting it to a different position along said post member said post member being coupled to said cylindrically shaped member to said cylindrically shaped member; wherein said post member is L-shaped having first and second leg portions; and wherein said shaped member has a receiving member with a channel therein, said receiving member being positioned on the outer surface of said shaped member, said first leg portion of said post member extending into the channel formed in said receiving member.

2. The device of claim 1 wherein said cylindrically shaped member has a plurality of rib members extending along the interior surface thereof.

3. The device of claim 1 further including first and second lip members formed at one end of said cylindrical member.

4. The device of claim 3 further including a safety latch coupled to said lip members whereby said cylindrically shaped member is secured to said golf club.

5. The device of claim 1 wherein the interior surface of said cylindrically shaped member is tapered.

6. The device of claim 1 wherein said post member is integral with said cylindrically shaped member.

7. The device of claim 1 further including a plurality of rib members formed at the bottom of said post member and coupled to the outer surface of said cylindrically shaped member.

8. The device of claim 1 wherein said first leg portion has upper and lower surfaces and extends through said channel, said lower surface having a cavity formed therein.

9. The device of claim 8 wherein the surface of said shaped member has a protrusion formed thereon adjacent said receiving member, said protrusion extending into said cavity when positioned above said cavity thereby securing said post member to said cylindrically shaped member.

* * * * *